United States Patent [19]

Lisec

[11] Patent Number: 4,716,686

[45] Date of Patent: Jan. 5, 1988

[54] DEVICE FOR TREATING THE EDGE ZONES OF PLATE-SHAPED ELEMENTS

[76] Inventor: Peter Lisec, Bahnhofstrasse 34, A-3363 Amstetten-Hausmening, Austria

[21] Appl. No.: 744,753

[22] Filed: Jun. 14, 1985

[30] Foreign Application Priority Data

Jun. 14, 1984 [AT] Austria ..... A1945184

[51] Int. Cl.[4] ..... B24B 7/00

[52] U.S. Cl. ..... 51/76 R; 51/235; 51/240 GB; 198/836; 198/721; 198/339.1

[58] Field of Search ..... 51/37, 283 E, 165.72, 51/284 E, 39, 235, 74 R, 76 R, 110, 165.75, 240.6 B, 238 R, 3; 198/836, 627, 721, 339.1

[56] References Cited

U.S. PATENT DOCUMENTS

| | | | |
|---|---|---|---|
| 1,831,617 | 11/1931 | Adams | 51/240 GB |
| 2,551,332 | 5/1951 | Moore et al. | 51/110 |
| 2,671,241 | 3/1954 | Starner | 198/836 |
| 3,827,547 | 8/1974 | Nixon | 198/721 |
| 3,835,591 | 9/1974 | Cimprich | 51/165.72 |
| 3,918,209 | 11/1975 | Crawley et al. | 51/47 |
| 3,932,962 | 1/1976 | Devillers | 51/165.72 |
| 4,060,938 | 12/1977 | Barron | 51/240 GB |
| 4,354,796 | 10/1982 | Bergman | 198/721 |
| 4,375,738 | 3/1983 | bando | 51/3 |

FOREIGN PATENT DOCUMENTS

| | | | |
|---|---|---|---|
| 2939571 | 4/1981 | Fed. Rep. of Germany | 51/235 |
| 0010446 | 1/1983 | Japan | 51/283 R |

*Primary Examiner*—Robert P. Olszewski
*Assistant Examiner*—Bradley I. Vaught
*Attorney, Agent, or Firm*—Young & Thompson

[57] ABSTRACT

In a device for the treatment of the edge zones of plate-shaped elements, a conveyor (3) for the plate-shaped element and a treatment tool (17) movable to and fro transversely to the conveying direction are provided. In opposition to the treatment tool (17), on upright bracing roll (15), rotatable about an axis extending transversely to the conveying direction, is provided for te plate-shaped element. The conveyor (3) comprises a carrier unit (8) for the plate-shaped element, which carrier unit can be moved together with the conveyor selectively in synchronism.

16 Claims, 2 Drawing Figures

DEVICE FOR TREATING THE EDGE ZONES OF PLATE-SHAPED ELEMENTS

Figure 1:
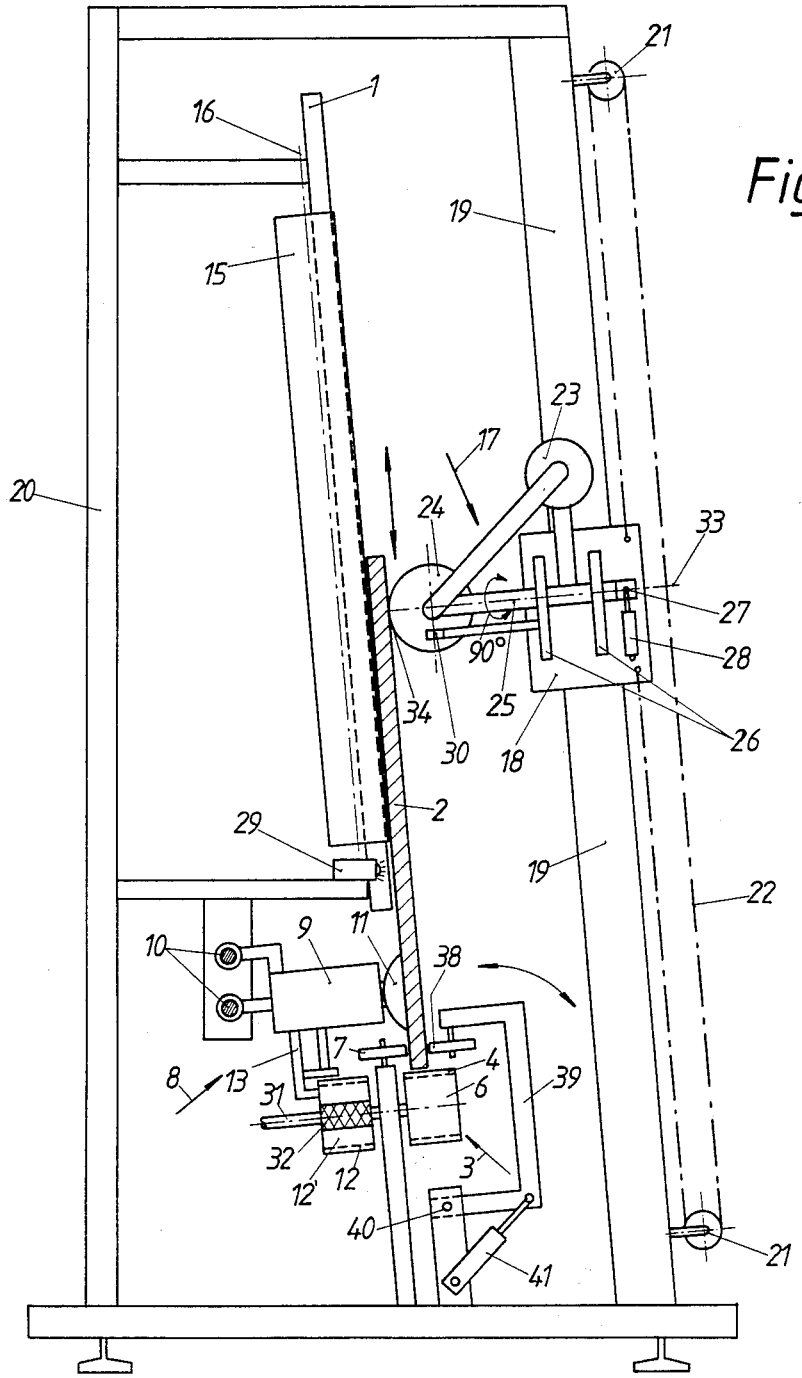

The invention relates to a device for the treatment of the edge zones of surfaces of plate-shaped elements, particularly for treating the edge zones of sheet glass, with a lateral supporting wall, preferably fashioned as an air cushion wall, for the elements, which latter are arranged substantially upright, and with a conveying means arranged at the bottom edge of the supporting wall, preferably in the form of at least one endlessly circulating conveyor belt. The treatment tool can be, in particular, a polishing disk or a grinding wheel.

In the treatment and processing of plate glass, the problem is frequently encountered of having to treat the surfaces of glass sheets in the edge zone thereof. One example in this connection is the removal of a coating, for example vapor-phase deposited metallic layers in the marginal zone of the metallized glass sheets, or grinding of the edge zones.

The invention is based on the problem of providing a device making it possible to treat plate-shaped elements in their edge zone, for example for the above-mentioned removal of a coating, without damaging the remaining portions of the coating. This is not simple, especially in the treatment of metallized glass sheets, since the metallic layers are very easily damaged.

According to the invention, this problem has been solved with a device of the type discussed hereinabove by providing that a treatment tool is guided to be displaceable upwards and downwards along a substantially vertical guide rail connected to the stand of the device, that an essentially vertical slot is provided in the supporting wall in opposition to the treatment tool, a bracing roll rotatable about an essentially vertical axis and at least partly penetrating the slot in the supporting wall being arranged in the slot, and that a carrier unit for the plate-shaped element is disposed between the lower end of the supporting wall and the conveying means and in opposition to the treatment tool, based on the plate-shaped element, which carrier unit is at least intermittently movable in synchronism with the conveying means.

Owing to the special design of the conveying means, arranged at the lower end of the lateral supporting wall, which latter can be fashioned as a roller wall, a drum wall, or as an air cushion wall, in conjunction with the carrier unit, the elements to be treated can be precisely guided and moved during the treatment of the edge zones with the treatment tool.

Due to the fact that an essentially vertical slot is provided in the supporting wall in opposition to the treatment tool, this slot accommodating a bracing roll rotatable about an essentially vertical axis, which roll lies oppositely to the treatment tool and penetrates at least partly the slot in the supporting wall, the advantage is attained particularly when treating thin and consequently breakage-prone glass sheets that the pressure exerted by the treatment tool on the element to be treated is absorbed by the bracing roll lying in opposition to the treatment tool.

Advantageously, the provision can be made within the scope of this invention to guide the treatment tool along the guide rail by way of a slide, and to mount the tool on the slide to be pivotable by 90°. On account of the pivotability of the treatment tool by 90°, the device of this invention can also be designed so that it is extensively or completely automatic, it being possible to treat all four edge zones.

In one embodiment of the invention, a revolving polishing disk or the like can be provided as the treatment tool.

An especially reliable guidance of the element during the treatment procedure is achieved if the carrier unit comprises at least one vacuum suction means which is mounted on a slide guided in parallel to the conveying means. This embodiment is moreover distinguished by great simplicity.

Synchronization of the carrier unit with the conveying means is attained most simply by providing, for the motion drive of the carrier unit, an endless belt extending in parallel to the conveying means, for example a toothed belt which can be selectively coupled with the drive mechanism for the conveying means and/or can be used to fixedly clamp thereto the slide of the carrier unit.

In order to reliably support the plate-shaped element during treatment of the bottom horizontal edge, the provision is made according to this invention that freely rotatable supporting rollers are arranged on the side of the conveying means facing the supporting wall; the areas of these rollers that are in contact with the plate-shaped element are located substantially in the plane of the supporting wall.

If the device is to operate extensively or entirely automatically, then it is recommended to associate, with the drive mechanisms for the treatment tool, for the conveying means, and for the carrier unit, conventional contrivances which detect the dimensions and the position of the plate-shaped element to be treated, such as light barriers, proximity switches, or the like. In this connection, an embodiment is preferred wherein a contrivance detecting the presence of a plate-shaped element, for example a light barrier or the like, is arranged at the lower end of the bracing roll in the effective plane of the treatment tool wherein also the axis of the bracing roll is disposed, or wherein a contrivance is provided on the slide of the treatment tool which detects the upper horizontal edge of the plate-shaped element leaning against the supporting wall.

Figure 2:
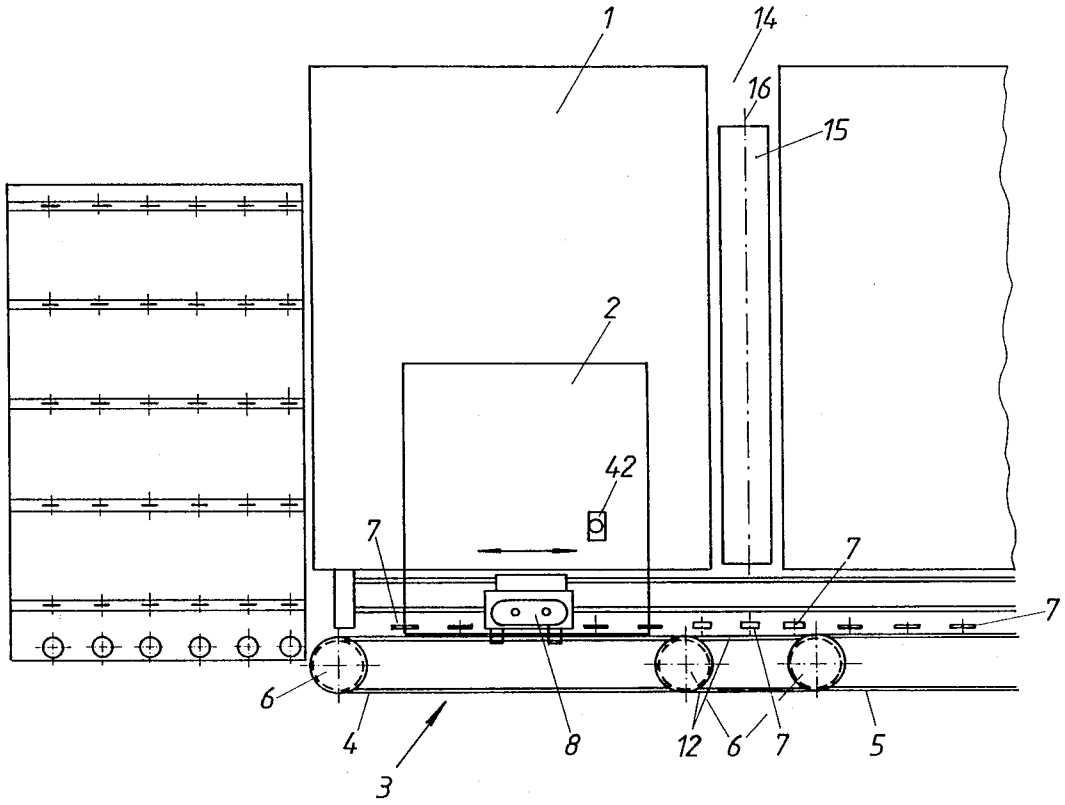

Additional features and details of the invention can be derived from the following description of the embodiment schematically illustrated in the drawings wherein:

FIG. 1 shows the essential components of the device in a lateral view, partially in section, and FIG. 2 shows the device in a front view.

The device comprises a lateral supporting wall 1 fashioned in the illustrated embodiment as an air cushion wall, for the plate-shaped elements to be treated, such as, for example, metallized glass panes 2. A conveying means 3 is arranged below the supporting wall 1. In front of (see FIG. 2) and also behind the device, respectively one feeding conveyor and one discharge conveyor can be located.

The conveying means 3 includes, in the illustrated embodiment, two endlessly circulating conveyor belts 4 and 5 traveling around drive and/or guide rollers 6, the glass panes 2 to be treated standing upright thereon. Above the conveyor belts 4 and 5, freely rotatable rollers 7 are provided which preferably consist of an elastic material and which, in the lower horizontal edge zone of the glass pane 2, are in contact along the side against the surface of the glass pane which slides along the supporting wall 1.

A carrier unit 8 is disposed between the lower end of the supporting wall 1 and the conveyor belts 4 and 5. This carrier unit 8 comprises a slide 9 displaceably guided on guide rails 10 in parallel to the longitudinal extension of the conveyor belts 4 and 5. The slide 9 carries at least one suction cup 11 facing the surface of a glass pane 2 in contact with the supporting wall 1.

For moving the carrier unit 8, a toothed belt 12 is associated therewith, drivable at the same linear speed as the conveyor belts 4 and 5. This can be effected, for example, by having the toothed belt 12 travel around drive gears 12' arranged coaxially to the drive gears 6 of the conveyor belts 4 and 5. If, now, the carrier unit 8 is to be moved in synchronism with the conveyor belts 4 and 5, then it is driven by the toothed belt 12. This can be done either by a clamp 13 effecting a force-locking and/or shape-mating connection between the toothed belt 12 and the slide 9 of the carrier unit 8 and/or by having the slide 9 of the carrier unit 8 continuously coupled with the toothed belt 12 and providing a releasable coupling 32 between the drive shaft 31 and the drive gear 12' of the toothed belt 12.

In any event, this arrangement of the drive mechanism for the carrier unit 8 has the result that the latter can remain at a standstill even with the conveyor belts 4 and 5 being set into operation, and, during its use, will be moved in any event in synchronism with, i.e. with the same linear speed as the conveyor belts 4 and 5.

As can be seen from the drawings, a slot 14 is provided in the supporting wall 1, through which a bracing roll 15 extends with a substantially vertical axis 16 in parallel to the plane of the supporting wall 1. By means of this bracing roll 15, a glass pane 2 is supported in the region of the slot 14 of the supporting wall; it is also possible to arrange several bracing rolls in place of this bracing roll, and the latter, if desired, can be driven with a peripheral speed corresponding to the conveying velocity of the conveyor belts 4 and 5.

A treatment tool 17 is disposed in opposition to the slot 14 in the supporting wall 1 and/or to the bracing roll 15 arranged in this slot. The treatment tool 17 is displaceable upwards and downwards via a slide 18 on a guide rail 19 extending in parallel to the supporting wall 1. The guide rail 19 is rigidly connected to a frame 20 of the device, to which are also attached the supporting wall 1 and the conveying means 3, as well as the carrier unit 8. For moving the slide 18 and thus the treatment tool 17, the slide 18 is connected with a chain 22 traveling over guide rollers 21 and driven by a motor, not shown in detail.

The slide 18 carries the disk 24, drivable, for example, as by a motor 23 and serving as the treatment tool, by way of a rocker shaft 25 which latter, in turn, is accommodated in bearing plates 26 affixed to the slide. A pressure medium cylinder 28 engages the rocker shaft 25 by way of a lever 27 connected to the shaft, so that the disk 24 is pivoted, from the position shown in FIG. 1 with an essentially horizontal axis of rotation intended for the treatment of the perpendicular edge zones of the glass pane 1, about an angle of 90° into a position wherein the axis of rotation of the disk 24 is oriented essentially vertically, intended for the treatment of the upper end lower horizontal edge zones of the glass pane 2.

A light barrier 29, which can be designed, for example, as a reflection light barrier, is arranged underneath the roll 15 in the slot 14 in opposition to the treatment tool 17. This light barrier 29 detects the essentially vertically aligned rims of the glass pane 2. A further light barrier 30 is arranged on the slide 28, by means of which the upper horizontal rim of the glass pane 2 can be detected.

The traveling path of the slide 18 in the downward direction is delimited so that, in the lower end position, the treatment tool 17, or in the illustrated embodiment the treatment disk 24, is aligned in the correct level position for the treatment of the lower horizontal edge of the glass pane 2, the level alignment of the latter being, after all, determined by the conveyor belts 4 and 5.

The just-described device operates as follows:

In the starting position, the slide 18 with the treatment tool 17 is in its lower end position, and the carrier unit 8 is in a region proximate to the slot 14 in the supporting wall 1, but, as seen in the direction of travel, lying in front of the slot. At this point, via the feeding conveyor, a glass pane 2 to be treated is moved into the device until the forward vertical edge of the pane is detected by the light barrier 29 whereupon the conveyor belts 4 and 5 are arrested. The glass pane then assumes a position wherein its forward vertical edge is in exact opposition to the treatment tool, pivoted into its position about the horizontal axis of rotation of the disk 24, and is supported from the rear by the roll 15. At this point, the suction cup 11 of the carrier unit 8 is activated, and the carrier unit 8 is coupled with the drive mechanism for the conveyor belts 4 and 5 in the manner described above.

Triggered by a follow-up control, for example, the slide 18 and thus the treatment tool 17 are then moved in the upward direction until the disk 24 is in the frontal upper corner of the glass pane 2. Stopping of the slide 18 in this level position is effected by the light barrier 30. Now the treatment tool 17 is pivoted by 90° by operating the pressure medium cylinder 28 so that the axis of the disk 24 is presently aligned in an essentially vertical direction. The drive means for the conveyor belts 4 and 5 and thus also the carrier unit 8 are then set into motion, and the disk is moved further to the right, as seen in FIG. 2, during which movement the upper horizontal edge zone of the glass pane 2 is being treated. As soon as the second (rearward) vertical edge of the glass pane 2 has reached the light barrier 29, the glass pane 2 is stopped by arresting the drive mechanisms for the conveyor belts 4 and 5 and the carrier unit 8, the disk 24 is pivoted back into its initial position by activating the pressure medium cylinder 28, and the slide 18 is moved downwards, simultaneously treating the rearward edge zone of the glass pane 2. As soon as the slide 18 has reached its lower end position, the disk 24 is again pivoted and thereupon the drive mechanisms for the conveyor belts 4 and 5 and the carrier unit 8 are set into motion so that the pane is moved toward the left as seen in FIG. 2, during which movement the lower horizontal edge zone of the glass pane 2 is being treated.

After this edge zone treatment is finished, the vaccum suction means 11 is detached from the pane 2, and the coupling 31 of the drive mechanism for the carrier unit 8 is released again from the drive mechanism for the conveyor belts 4 and 5. Thereupon the conveyor belts 4 and 5 can be set into motion for discharging the glass pane 2.

The supporting wall 1 can be fashioned, instead of being an air cushion wall, also as a conventional supporting roller wall.

In place of the polishing disk or grinding wheel 24, the treatment tool can also comprise a burner with one or several nozzles, the nozzle(s) being oriented toward the glass pane.

As indicated in FIG. 2, the freely rotatable rollers 7 provided in the zone of the bracing roll 15 are designed to be broader than the remaining, freely rotatable rollers 7 The reason for this is that these rollers 7 are opposed by guide rollers 38 that can be brought into contact with the surface of the glass pane 2 to be treated. For this purpose, these guide rollers 38 are mounted to a frame 39 supported in the stand 20 of the device to be pivotable about an axle 40 by means of a pressure medium cylinder 41. Normally, two guide rollers 38 will be provided on the frame, arranged on both sides of the treatment tool 17 when the latter is in its lower starting position. The frame 39 has two arms, for example, which are disposed on both sides of the movement route of the treatment tool 17 and, extending with their upper ends over the conveyor belts 4 and 5, carry the guide rollers 38.

It is to be understood that it is possible to provide a further edge treatment tool, intended for treating the lower horizontal edge zone of a plate-shaped element 2, in addition to the upwardly and downwardly shiftable treatment tool 17, for example to treat the lower horizontal edge of a glass pane in the region of an interruption of the conveying means 3.

The carrier unit 8 provided in accordance with this invention can also be coupled with the plate-shaped element 2 even before the latter has reached the end position, detected by the light barrier 29, for the treatment of the vertical edge zone leading in the movement direction. For this purpose, a further light barrier 42 can be arranged in the zone of the supporting wall 1.

I claim:

1. In a device for the treatment of the edge zones of surfaces of plate-shaped elements, comprising an upright lateral supporting wall (1) for the elements, which lateral are arranged substantially upright, conveying means (3) for the elements at the bottom edge of the supporting wall (1), a treatment tool (17) guided to be displaceable upward and downward along a substantially vertical guide rail (19) connected to a stand (20) of the device; there being a substantially vertical slot (14) in the supporting wall (1) opposite the treatment tool (17), and a bracing roll (15) rotatable about a substantially vertical axis (16) and at least partly penetrating said slot (14) in the supporting wall (1); said wall extending on both sides of said slot, and the bracing roll being opposite the treatment tool so that the pressure exerted by the treatment tool on a said element is absorbed by the bracing roll; the improvement comprising a carrier unit (8) for the plate-shaped element (2), said carrier unit being disposed between the lower end of the supporting wall (1) and the conveying means (3) and on the side of the plate-shaped element which is opposite the treatment tool (17), the carrier unit (8) being guided in parallel overlapping relationship to the conveying means (3), whereby said plate shaped element (2) is supported by both said carrier unit (8) and said conveying means (3), and means for at least intermittently moving the carrier unit in synchronism with the conveying means (3).

2. Device according to claim 1, characterized in that the treatment tool (17) is guided on the guide rail (19) by way of a slide (18) and is mounted on the slide (18) to be pivotable by 90°.

3. Device according to claim 1, characterized in that a rotating abroder (24) is provided as the treatment tool (17).

4. Device according to claim 1, characterized in that the carrier unit (8) comprises at least one vacuum suction means (11) mounted on a slide (9).

5. Device according to claim 4, characterized in that an endless belt (12) extending in parallel to the conveying means (3) is provided for the moving drive of the carrier unit (8).

6. Device according to claim 1, characterized in that freely rotatable supporting rollers (7) are arranged on the side of the conveying means (3), the areas of these supporting rollers which are in contact with the plate-shaped element (2) lying essentially in the plane of the supporting wall (1).

7. Device according to claim 1, characterized in that at least one contrivance detecting the presence of a plate-shaped element (2) is disposed at the lower end of the bracing roll (15) in the effective plane of the treatment tool, wherein also lies the axis (16) of the bracing roll (15).

8. Device according to claim 1, characterized in that a contrivance (30) detecting the upper horizontal edge of the plate-shaped element (2) is arranged on the slide (18) of the treatment tool (17).

9. Device according to claim 6, characterized in that the supporting rollers (7) are provided on both sides of the vertical bracing roll (15).

10. Device according to claim 1, characterized in that freely rotatable guide rolls (38) are provided which are adapted to be brought into contact with the lower edge of the surface to be treated of the plate-shaped element (2).

11. Device according to claim 10, characterized in that at least one guide roller (38) is located on each side of the bracing roll (15).

12. Device according to claim 10, characterized in that the guide rollers (38) are arranged on a frame (39) movable transversely to the plate-shaped elements (2).

13. Device according to claim 12, characterized in that the frame (39) is adapted to be tilted about an axle (40) disposed underneath the conveying means (3) and lying in parallel to the conveying direction.

14. Device according to claim 5, characterized in that the endless belt (12) for the carrier unit (8) and the conveying belt (4, 5) for the conveying means (3) travel over coaxial drive gears (6, 12'), the drive gear (12') for the belt (12) being connected by way of a releasable coupling (32) with the drive shaft (31) for the drive gear (6) of the conveying means (3).

15. Device according to claim 1 characterized in that a further treatment tool for treating the lower horizontal edge of the plate-shaped element (2) is arranged in the region of the level of the conveying means (3).

16. Device according to claim 1, characterized in that a pivoting axis (33) of the treatment tool (17, 24) passes through the point (34) of the treatment tool (17, 24) that acts on the plate-shaped element (2).

* * * * *